US005399032A

United States Patent [19]

Itoh et al.

[11] Patent Number: 5,399,032

[45] Date of Patent: Mar. 21, 1995

[54] PRINT HEAD HAVING REPLACEABLE PRINT ELEMENTS FOR WIRE DOT-MATRIX PRINTER

[75] Inventors: Kiyoshi Itoh; Minoru Hara, both of Kawasaki, Japan

[73] Assignee: Fujitsu Limited, Kawasaki, Japan

[21] Appl. No.: 984,661

[22] Filed: Dec. 2, 1992

[30] Foreign Application Priority Data

Dec. 4, 1991 [JP] Japan ..... 3-320260
Dec. 6, 1991 [JP] Japan ..... 3-323313

[51] Int. Cl.[6] ..... B41J 2/295

[52] U.S. Cl. ..... 400/124.16; 400/124.12; 400/157.1; 101/93.48; 101/93.05

[58] Field of Search ..... 400/124, 124 PZ, 157.1 PZ, 400/124.16, 124.11, 124.12; 101/93.04, 93.05, 93.48; 310/311, 328, 330, 331, 332, 345, 348, 354, 355, 356; 174/72 TR, 75 R, 84 R, 86

[56] References Cited

U.S. PATENT DOCUMENTS 4,373,440 2/1983 Jezbera ..... 101/93.48
4,590,853 5/1986 Nickels, Jr. et al. ..... 101/93.48
5,008,496 4/1991 Schmidt et al. ..... 174/254

FOREIGN PATENT DOCUMENTS 57-105377 6/1982 Japan .
173177 10/1982 Japan ..... 400/124
26273 2/1984 Japan ..... 400/124 PZ
229349 12/1984 Japan ..... 400/124 PZ
31976 2/1985 Japan ..... 400/124 PZ
97864 5/1985 Japan ..... 400/124 PZ
2-57355 2/1990 Japan .
3-71855 3/1991 Japan .
148941 5/1992 Japan ..... 400/124

*Primary Examiner*—David A. Wiecking
*Attorney, Agent, or Firm*—Nikaido, Marmelstein, Murray & Oram

[57] ABSTRACT

A print head for a wire dot-matrix printer includes an element base, and a plurality of print elements engaged with and supported by the element base. Each of the print elements includes a print wire, an actuator moving the print wire, and a base supporting the actuator, the base of each of the print elements having an engagement hole. An engagement member is inserted into the engagement hole of the base of each of the print elements and is engaged with the base of each of the print elements.

42 Claims, 11 Drawing Sheets

PRINT HEAD HAVING REPLACEABLE PRINT ELEMENTS FOR WIRE DOT-MATRIX PRINTER

DESCRIPTION OF THE PRIOR ART

1. Field of the Invention

The present invention generally relates to print heads for wire dot-matrix printers, and more particularly to a print head having a plurality of print elements which respectively have a print wire driven by an actuator using a piezoelectric material.

2. Description of the Prior Art

In recent wire dot-matrix printers, a piezoelectric material is used for actuators driving print elements in order to increase print speed. A print head is made up of a plurality of print elements fastened to an element base so that print wires respectively provided in the print elements are arranged at predetermined equal intervals. In order to arrange the print wires at the equal intervals, it is necessary to fasten the print elements to the element base with high precision.

FIG. 1 is a perspective view of a conventional wire dot-matrix printer of a shuttle bar system type. The wire dot-matrix printer shown in FIG. 1 comprises a shuttle mechanism 11, which is slidably supported at three supporting points 11*a* and 11*b* (the remaining supporting point is not illustrated) and reciprocates in directions indicated by arrow D1. A head assembly comprises a plurality of print heads, for example, 13 print heads mounted on the shuttle mechanism 11. A platen 12 is disposed so that it faces the shuttle mechanism 11. Paper 13 is inserted between the shuttle mechanism 11 and the platen 12. The paper is transported in the direction indicated by arrow D2 by means of tractors 14 and 15.

FIG. 2 is a front view of the shuttle mechanism 11. The print heads 21, 22, 23 and 24 (the remaining nine print heads are omitted) are obliquely disposed at a fixed angle and fastened to the shuttle mechanism 11. Each of the print heads includes 24 print elements grouped into opposing pairs. FIG. 2 shows the 24 print elements of only the print head 21.

FIG. 3A is a perspective view of the print head 21, and FIG. 3B is a perspective view of an element base 32, which is one structural element of the print head 21 and made of a metallic member having a low coefficient of thermal expansion. Each of the other print heads has the same structure as the print head 21. The print head 21 comprises four element assemblies 33, 34, 35 and 36, each having an identical structure. For example, the element assembly 33 has six print elements 31*a*–31*f*, which have an identical structure and are spaced apart from each other at fixed intervals. The six print elements 31*a*–31*f* are fastened to the element base 32 shown in FIG. 3B. The element base 32 has a comb-shaped structure having seven projections. Each of the six print elements 31*a*–31*f* is inserted into a space between two adjacent projections and engaged therewith. The element assemblies 33–36 are located at respective predetermined positions on a module base 37, and are fastened to the module base 37 by means of screws (not shown) or the like. Print wires extending from the element assemblies 33 and 34 are opposite to print wires extending from the element assemblies 35 and 36. The module base 37 has an opening 37A from which the print wires extending from the element assemblies 33–36 project.

FIG. 4A is a front view of the print element 31*a*, and FIG. 4B is a side view of the print element 31*a*. Each of the other print elements has the same structure as the print element 31*a*. The print element 31*a* is made up of an actuator 41, and a base 42 mechanically supporting the actuator 41. The actuator 41 has a piezoelectric element 41*a*, a joint member 41*b*, a block 41*c*, a beam 41*d*, a print wire 41*e*, and a spring member 41*f*. The piezoelectric element 41*a* has a first end fixed to the base 42, and a second end connected to the joint member 41*b*. The block 41*c* is connected to the joint member 41*b*. The beam 41*d* is fixed to the block 41*c*. The print wire 41*e* is fastened to the beam 41*d*. The spring member 41*f* has a first end fastened to the block 41*c*, and a second end fastened to the base 42. The base 42 has recesses 42*a* engaged with the element base 32 (FIG. 3B). Lead wires 43 are connected to the piezoelectric element 41*a*, by which a control voltage is applied thereto. In response to the control voltage, the piezoelectric element 41*a* is slightly expanded in the leftward direction in FIG. 4B, and the block 41*c* is pushed in the leftward direction via the joint member 41*b*. Thereby, the spring member 41*f* is contracted, and the block 41*c*, the beam 41*d* and the print wire 41*e* are turned in the counterclockwise direction. In this case, the print wire 41*e* projects leftwards, by approximately 350–400 microns, from a guide 37*b* (FIG. 4A) of an opening 37*a* (FIG. 3A) of the module base 37. Then, the print wire 41*e* presses against a ribbon, paper and platen provided on the left side of the print wire 41*e*. In this manner, a dot image is printed on the paper.

FIG. 5A is a perspective view of the piezoelectric element 41*a*, which is made up of a piezoelectric block 51, two electrodes 52A and 52B (FIG. 5B), leaf springs 53, two blocks 54 and 55, and a flexible printed wiring board 56. The piezoelectric block 51 comprises a plurality of (200, for example) piezoelectric layers stacked in the direction indicated by arrow D3. The electrodes 52A and 52B are formed on opposite sides of the piezoelectric block 51. The control voltage is applied to each of the piezoelectric layers in the direction D3. The leaf springs 53 permanently exert compression forces on the piezoelectric block 51 in the directions D3 in order to protect it. The blocks 54 and 55 are provided on respective ends of the block 51 and support the leaf springs 53.

FIG. 5C is a plan view of the flexible printed wiring board 56, which has an approximately L-shaped structure. FIG. 5D is a cross-sectional view of the flexible printed wiring board 56. As shown in FIG. 5D, the board 56 comprises a first insulating layer 57, a patterned conductive layer 58 made of, for example, copper, and a second insulating layer 59. A circular soldering window 56*a* for soldering is formed in the second insulating layer 59, so that the conductive layer 58 is partially exposed. The circular soldering window 56*a* is used for connecting one of the two lead wires 43 (FIG. 4B) respectively formed by the patterned conductive layers to the electrode 52A. A circular soldering window 56*b* is used for connecting the other lead wire 43 to the electrode 52B. A part of the printed wiring board 56 is wrapped around the block 51, as shown in FIG. 5A.

However, the print heads have the following disadvantages. The print elements 31*a*–31*f* are fastened to the element bases 32 by using an adhesive or a bonding material. Hence, it is not possible to detach the print elements 31*a*–31*f* from the element bases 32. If a failure has occurred in one of the print elements and the defective print element must be replaced with a new one, it is necessary to replace the element assembly in which the defective print element is provided with a new element assembly irrespective of whether or not the other print elements provided in the same element assembly normally operate. This is not economical.

Further, it is very difficult, because of insufficient flexibility of the flexible printed wiring board 56, to wrap the board 56 around a part of the piezoelectric block 51 so that it is completely in contact with the piezoelectric block body 51. Hence, it is very difficult to position the wiring board 56, and soldering failure may occur.

SUMMARY OF THE INVENTION

It is a general object of the present invention to provide a print head for a wire dot-matrix printer, in which the above disadvantages are eliminated.

A more specific object of the present invention is to provide a print head for a wire dot-matrix printer in which each print element is replaceable.

The above objects of the present invention are achieved by a print head for a wire dot-matrix printer comprising: an element base; a plurality of print elements engaged with and supported by the element base, each of the print elements including a print wire, an actuator moving the print wire, and a base supporting the actuator, the base of each of the print elements having an engagement hole; and an engagement member inserted into the engagement hole of the base of each of the print elements and engaged with the base of each of the print elements.

The above objects of the present invention are also achieved by a print head for a wire dot-matrix printer comprising: a module base; and a plurality of element assemblies supported by the module base. Each of the element assemblies comprises: an element base supported by one of the element assemblies; a plurality of print elements engaged with and supported by the element base, each of the print elements including a print wire, an actuator moving the print wire, and a base supporting the actuator, the base of each of the print elements having an engagement hole; and an engagement member inserted into the engagement hole of the base of each of the print elements and engaged with the base of each of the print elements.

The above objects of the present invention are also achieved by a print head for a wire dot-matrix printer comprising: a shuttle base; and a plurality of head units. Each of the head units comprises: a module base; and a plurality of element assemblies supported by the module base. Each of the element assemblies comprises: an element base supported by one of the element assemblies; a plurality of print elements engaged with and supported by the element base, each of the print elements including a print wire, an actuator moving the print wire, and a base supporting the actuator, the base of each of the print elements having an engagement hole; and an engagement member inserted into the engagement hole of the base of each of the print elements and engaged with the base of each of the print elements.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 6:
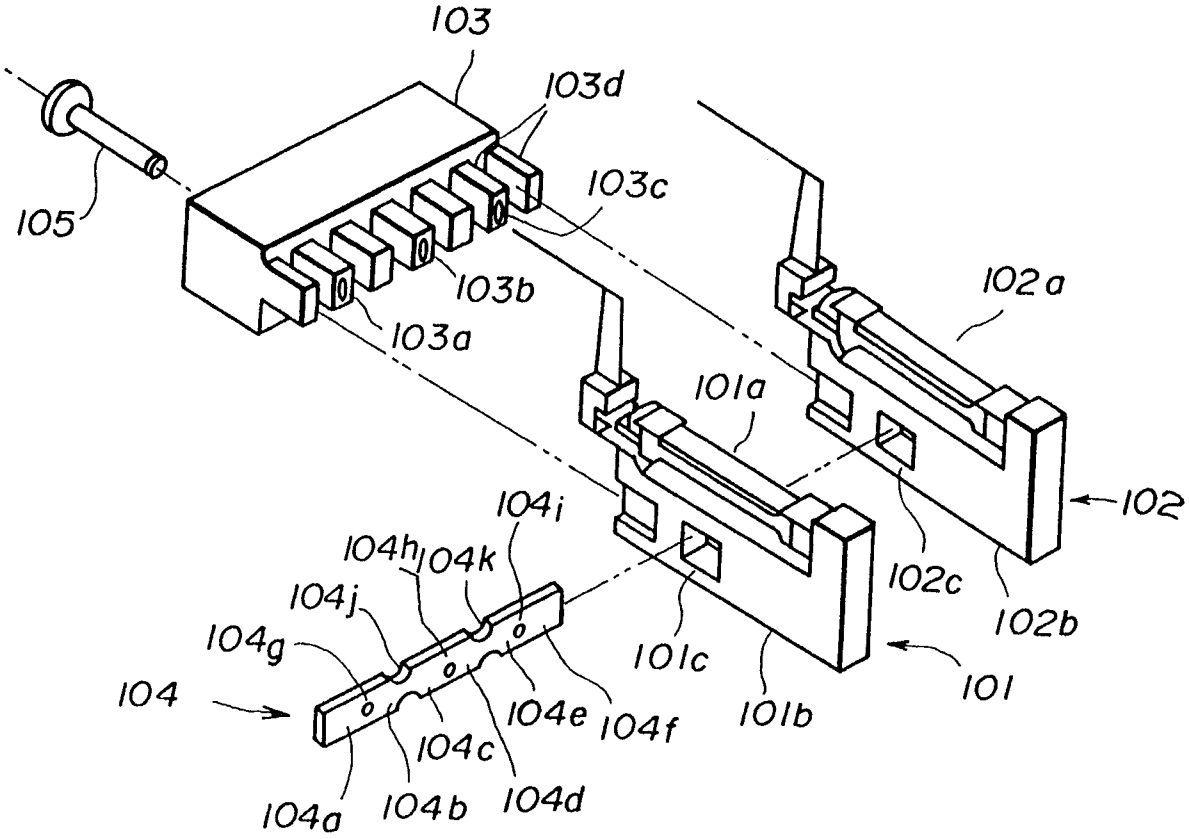
FIG. 6 is a perspective view of part of a print head according to an embodiment of the present invention.

FIG. 6 is a perspective view of part of a print head according to an embodiment of the present invention. In FIG. 6, parts that are the same as those shown in the previously described figures are given the same reference numbers.

Figures 7A, 7B:
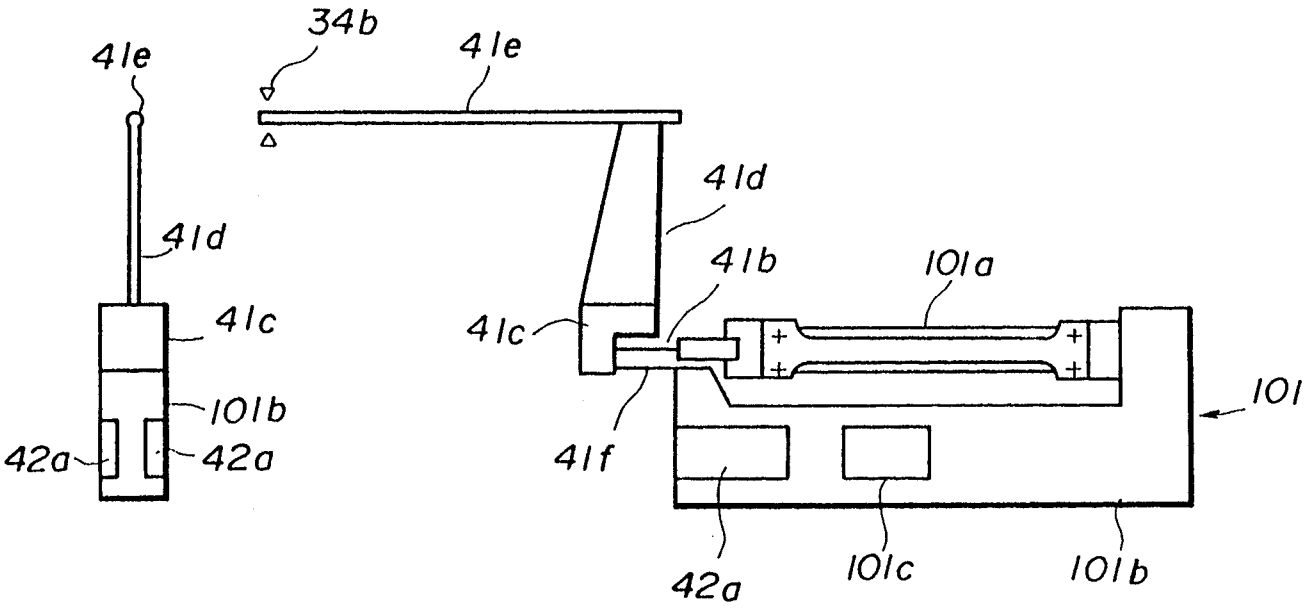
FIG. 7A is a front view of a print element used in the embodiment of the present invention shown in FIG. 6.
FIG. 7B is a side view of the print element shown in FIG. 7A.

The part of the print head shown in FIG. 6 comprises an element base 103, six print elements 101 and 102 (only two print elements are illustrated for the sake of convenience), and an engagement member 104. The print element 101 comprises a piezoelectric actuator **101*a*, and a base 101*b* supporting the piezoelectric actuator 101*a*. An engagement hole 101*c* is formed in the base 101*b*, and connects two opposite sides of the base 101*b* to each other in the direction substantially perpendicular to the direction in which the print wire 41*e* (FIG. 7A) of the print element 101** extends.

The print element 102 comprises a piezoelectric actuator **102*a*, and a base 102*b* supporting the piezoelectric actuator 102*a*. An engagement hole 102*c* is formed in the base 102*b*, and connects two opposite sides of the base 102*b* to each other in the direction substantially perpendicular to the direction in which the print wire of the print element 102 extends. Each of the remaining four print elements is configured in the same manner as the print element 101 or 102**.

The element base 103 has seven projections 103*d*. The two recesses 42*a* (FIGS. 7A and 7B) of each print element engage two adjacent projections 103*d*. Three of the seven projections 103*d* respectively have holes 103*a*, 103*b* and 103*c*. A screw 105 penetrates the hole 103*a*. Similarly, two screws (not shown for the sake of convenience) penetrate the holes 103*b* and 103*c*, respectively.

The engagement member 104 is a plate-shaped member having a length and width such that it is suitable to pass through the engagement holes 101*c* and 102*c* of the six print elements. The engagement member 104 has a property of resilience, and is made of, for example, a metallic material such as stainless steel or SPCC. It is also possible to make the engagement member 104 of resin. The engagement member 104 has six engagement portions 104*a*–104*f*, and three screw holes 104*g*, 104*h* and 104*i*. The screw 105 penetrates a hole of the element base 103 and engages the screw hole 104*g* of the engagement member 104 when the engagement member 104 is placed in position. Further the engagement member 104 has indentations 104*j* and 104*k*. The indentations 104*j* are located between the screw holes 104*g* and 104*h*, and the indentations 104*k* are located between the screw holes 104*k* and 104*i*. The width of the engagement member 104 measured at the indentations 104*j* and 104*k* is less than that measured at other portions thereof.

The piezoelectric actuators 101*a* and 102*a* can be configured as shown in FIGS. 5A through 5D. However, as will be described in detail later, it is preferable to use an improved piezoelectric actuator.

The six print elements 101 and 102 are fastened to the element base 103 by means of the engagement member 104 and the three screws 105 in the following process. The print elements 101 and 102 are inserted into spaces, each formed between two adjacent projections 103*d* of the element base 103. In this state, the engagement member 104 is inserted into the engagement holes 101*c* and 102*c* of the print elements 101 and 102 and is positioned so that the engagement portions 104*a*–104*f* engage the inner walls of the engagement holes 101*c* and 102*c* of the six print elements 101 and 102. Then, the three screws 105 are respectively inserted into the holes 103*a*, 103*b* and 103*c*, and are turned such that the three screws 105 engage the screw holes 104*g*, 104*h* and 104*i*. As the screws 105 are turned, the engagement member 104 is elastically deformed at the positions of the indentations 104*j* and 104*k*, and the engagement portions 104*a*–104*f* come into strong contact with the inner walls of the engagement holes 101*c* and 102*c* of the six print elements. Hence, all the print elements are tightly fastened to the element base 103 at the respective given positions. It will be noted that the indentations 104*j* and 104*k* of the engagement member 104 facilitate elastic deformation thereof. However, it is possible to omit the indentations if the engagement member without any indentations can be deformed by being screwed in. It can be seen from the above that one or more print elements can be easily replaced by a new one or more print elements.

Figure 1:
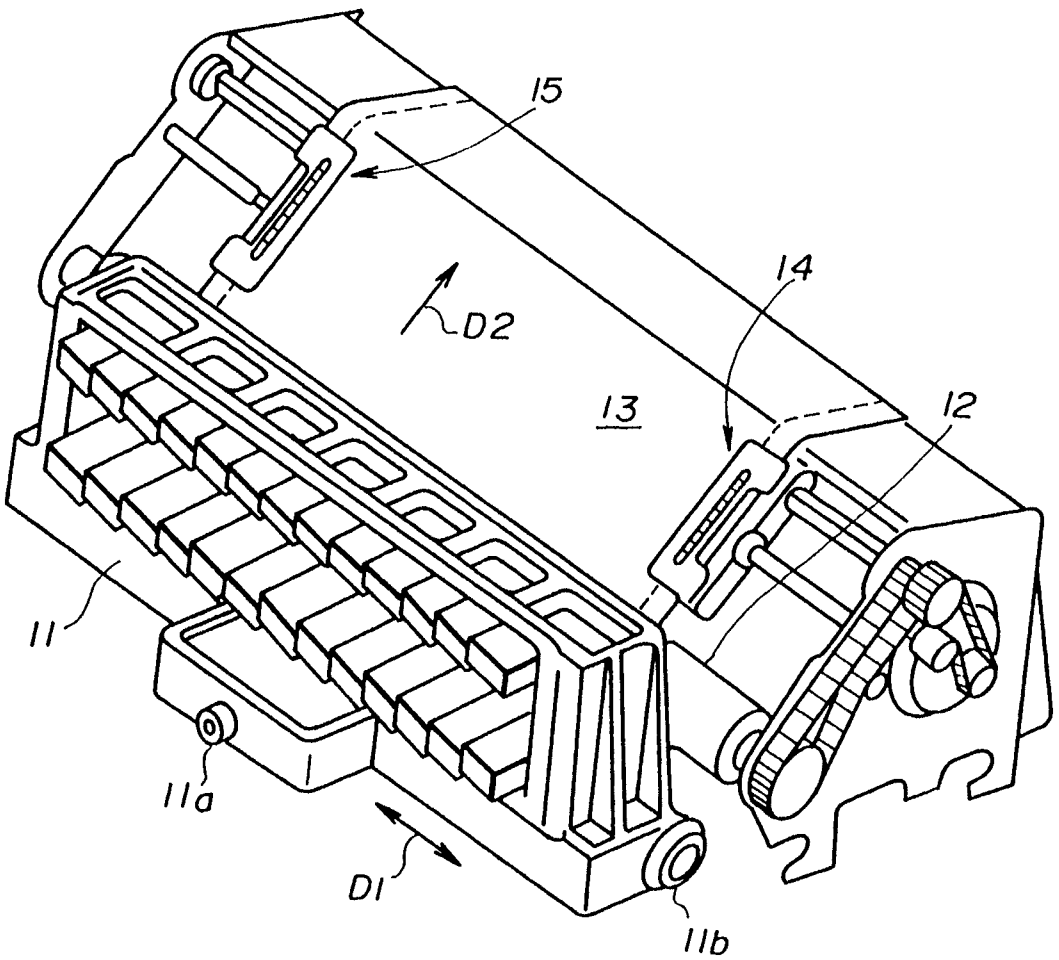
FIG. 1 PRIOR ART
FIG. 1 is a perspective view of a conventional shuttle bar system type wire dot-matrix printer.
Figure 2:
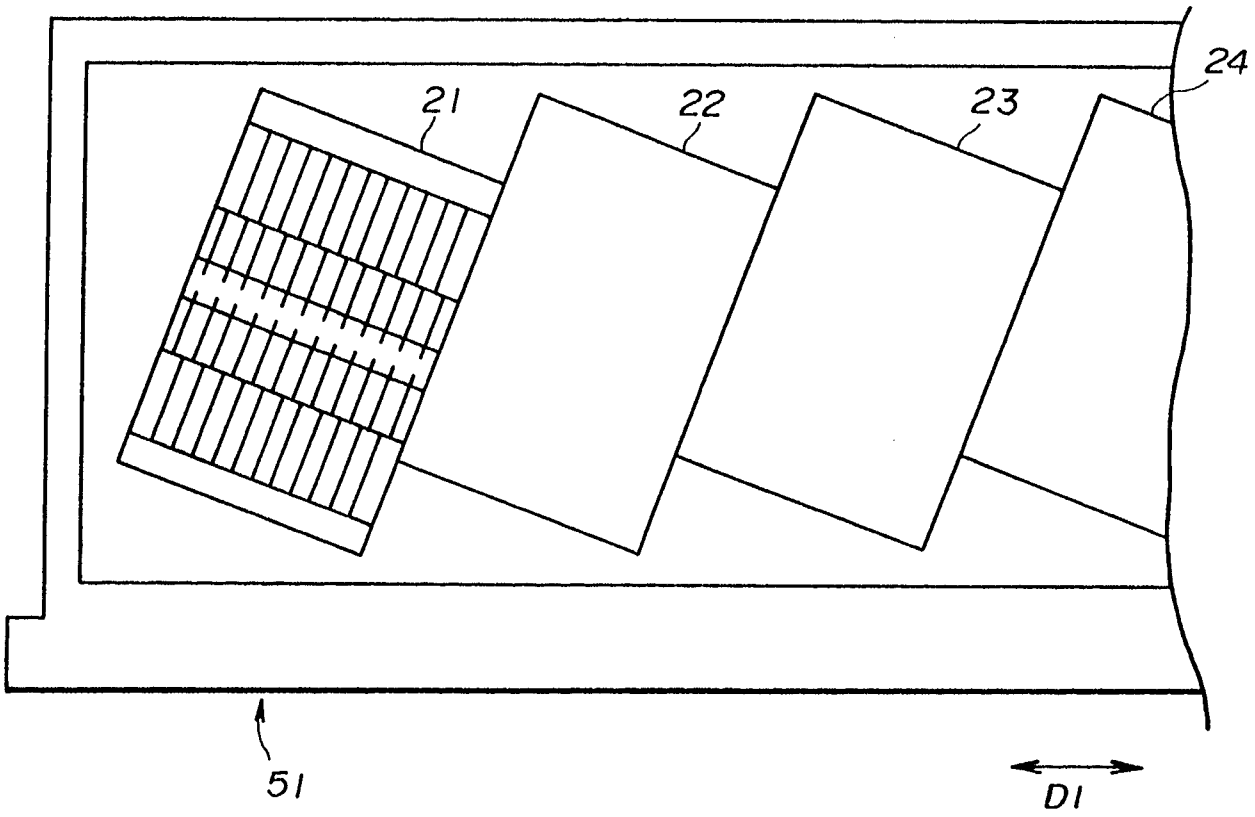
FIG. 2 PRIOR ART
FIG. 2 is a front view of a shuttle mechanism employed in the printer shown in FIG. 1.
Figure 3A:
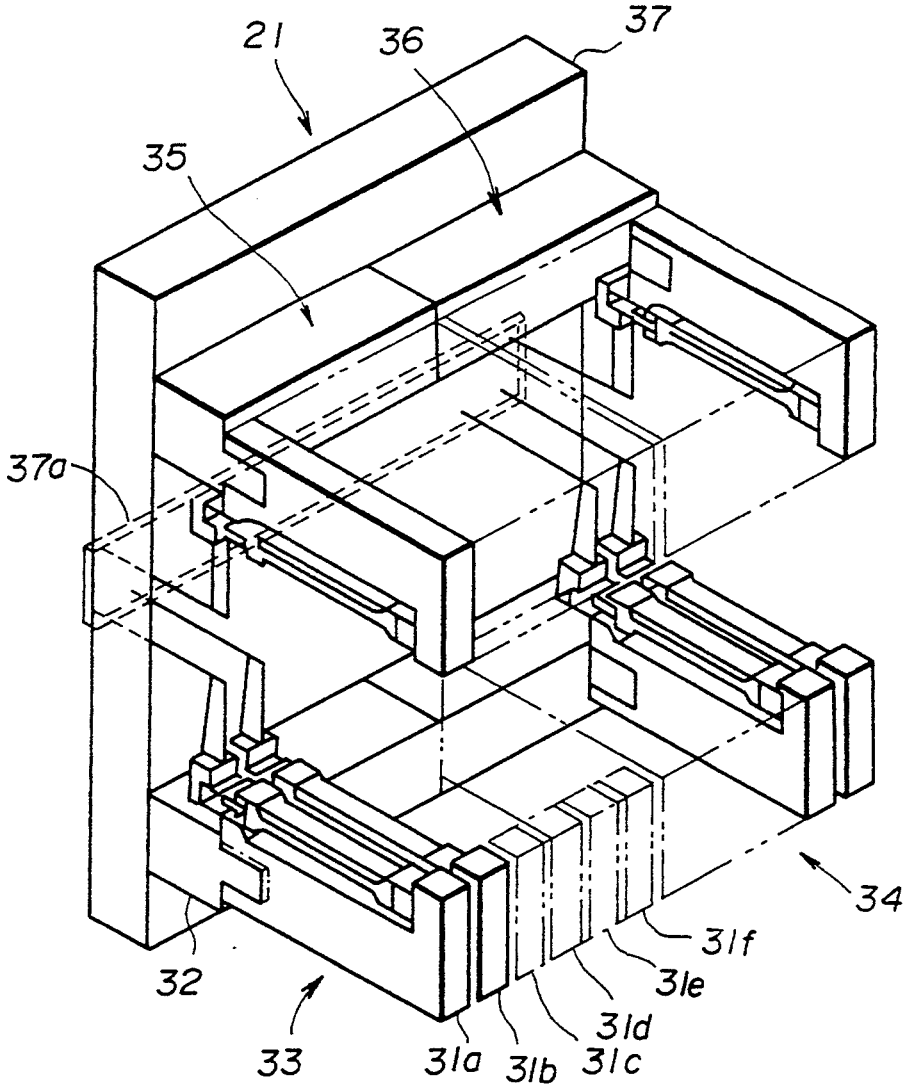
FIG. 3A PRIOR ART
FIG. 3A is a perspective view of a print head used in the printer shown in FIG. 1.
Figure 3B:
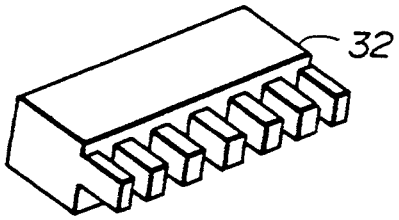
FIG. 3B PRIOR ART
FIG. 3B is a perspective view of an element base used in the printer shown in FIG. 1.
Figures 4A, 4B:
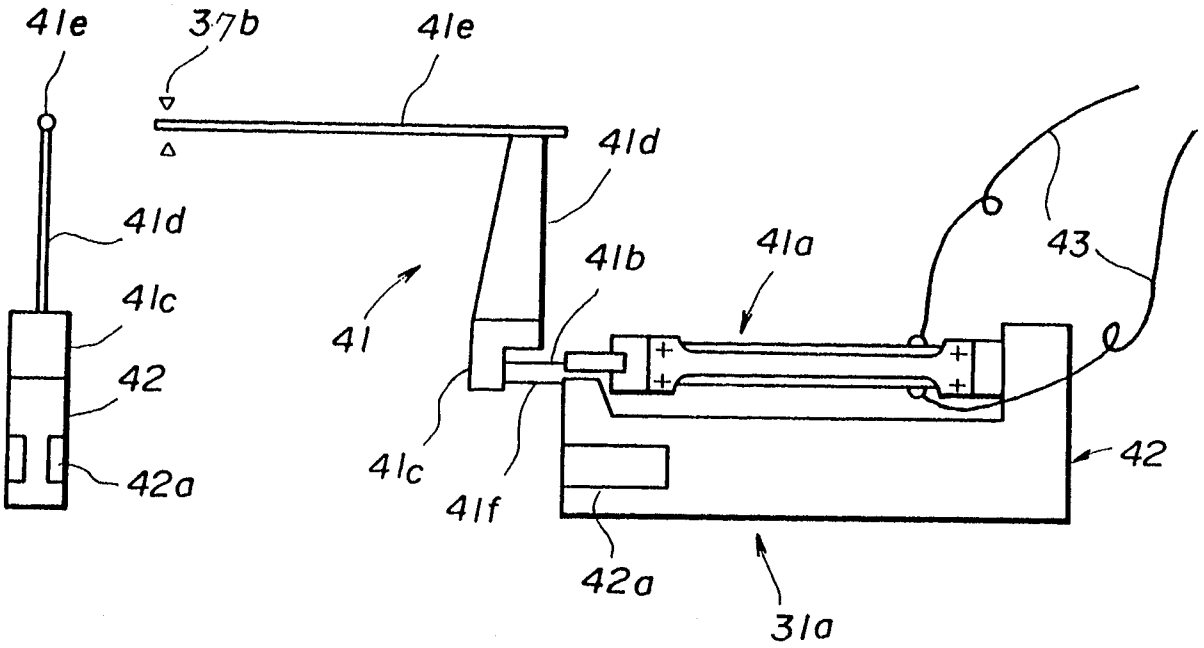
FIG.4B PRIOR ART
FIG.4A PRIOR ART
FIG. 4A is a front view of a print element used in the printer shown in FIG. 1.
FIG. 4B is a side view of the print element shown in FIG. 1.
Figure 8:
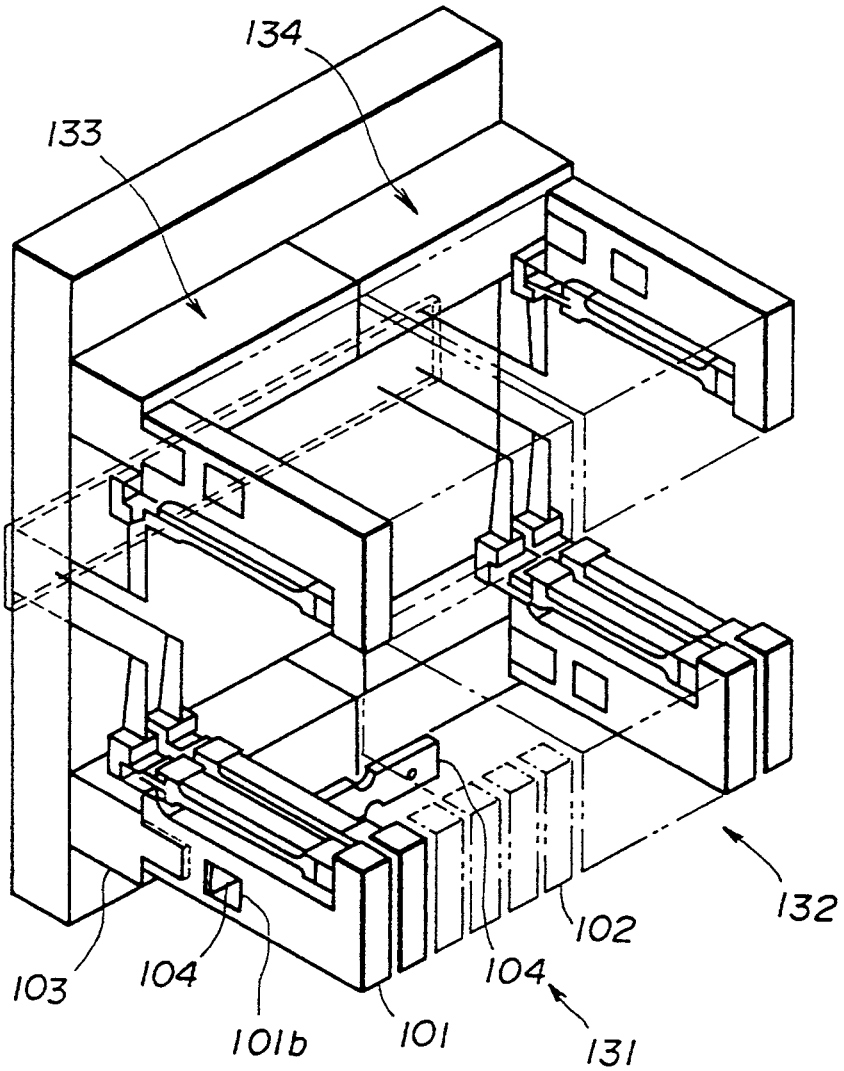
FIG. 8 is a perspective view of a print head having a plurality of element assemblies, each having the structure shown in FIG. 6.

FIG. 8 is a perspective view of a print head including four element assemblies 131, 132, 133 and 134, each of which is configured as shown in FIG. 6. In practice, a plurality of print heads, each having the structure shown in FIG. 8, are installed in a printing machine in the same manner as shown in FIG. 1.

Figures 9A, 9B:
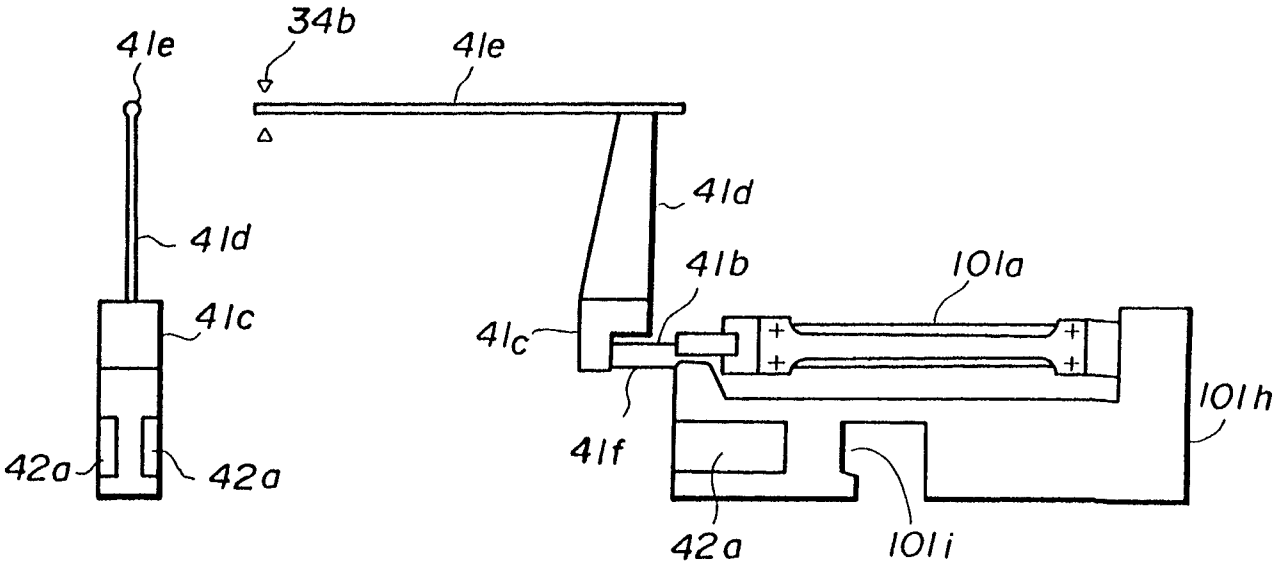
FIG. 9A is a front view of a variation of the print element shown in FIG. 6.
FIG. 9B is a side view of the variation shown in FIG. 6.

FIGS. 9A and 9B show a variation of the aforementioned piezoelectric actuator 101. A base 101*h* having an engagement cutout portion 101*i* is used in lieu of the base 101*b* having the engagement hole 101*c*. The engagement member 104 shown in FIG. 6 can be easily inserted into the cutout portion 101i from the bottom side of the base 101*h*.

Figure 5A:
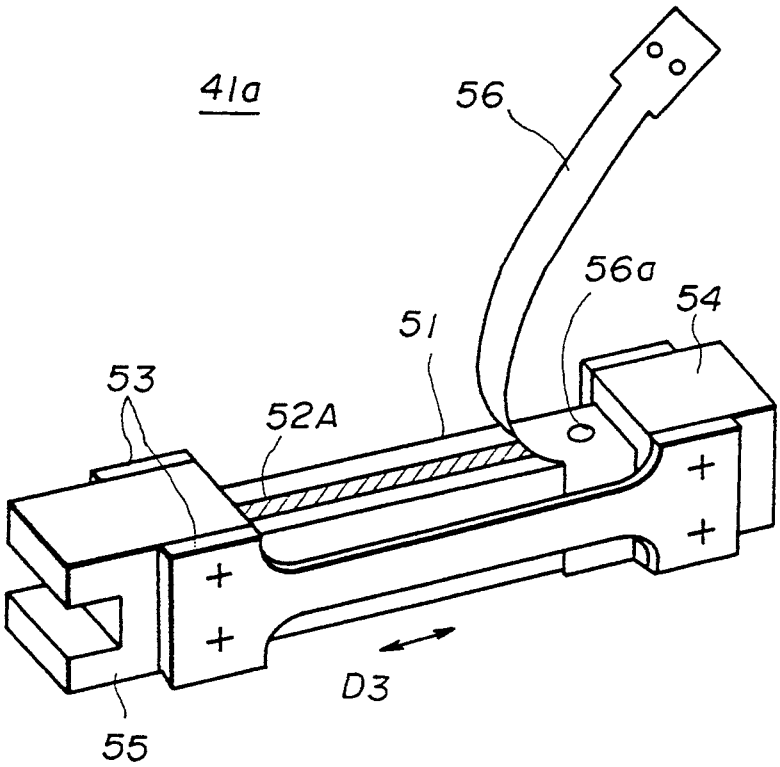
FIG. 5A PRIOR ART
FIG. 5A is a perspective view of a piezoelectric actuator.
Figure 5B:
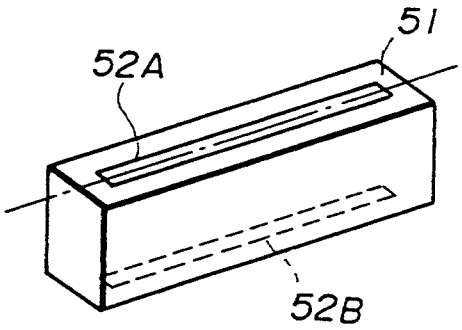
FIG. 5B PRIOR ART
FIG. 5B is a perspective view of a piezoelectric body of the actuator shown in FIG. 5A.
Figure 5C:
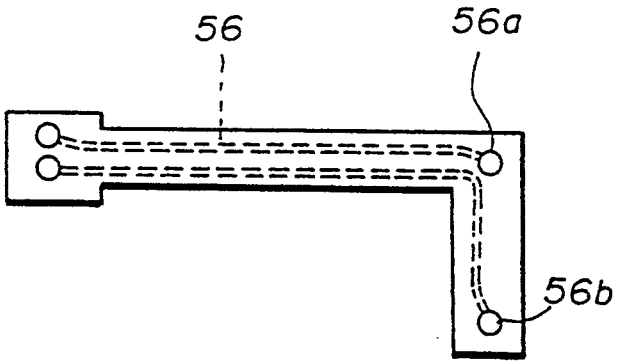
FIG. 5C PRIOR ART
FIG. 5C is a plan view of a flexible printed wiring board used in the actuator shown in FIG. 5A.
Figure 5D:
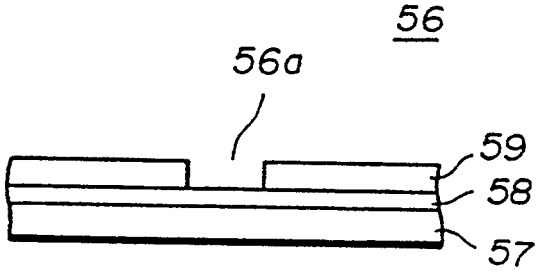
FIG. 5D PRIOR ART
FIG. 5D is a cross-sectional view of the wiring board shown in FIG. 5C.
Figure 10A:
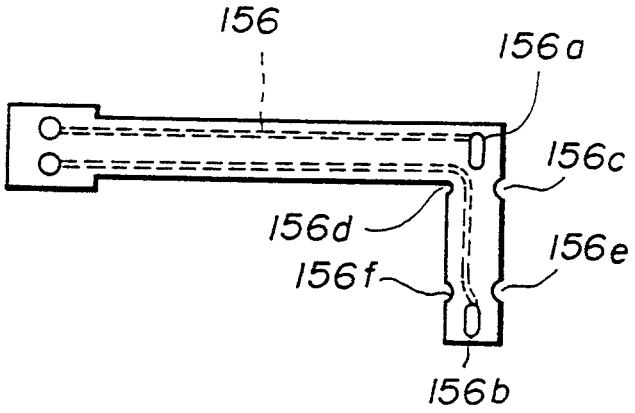
FIG. 10A is a plan view of a flexible printed wiring board used in embodiments of the present invention.
Figure 10B:
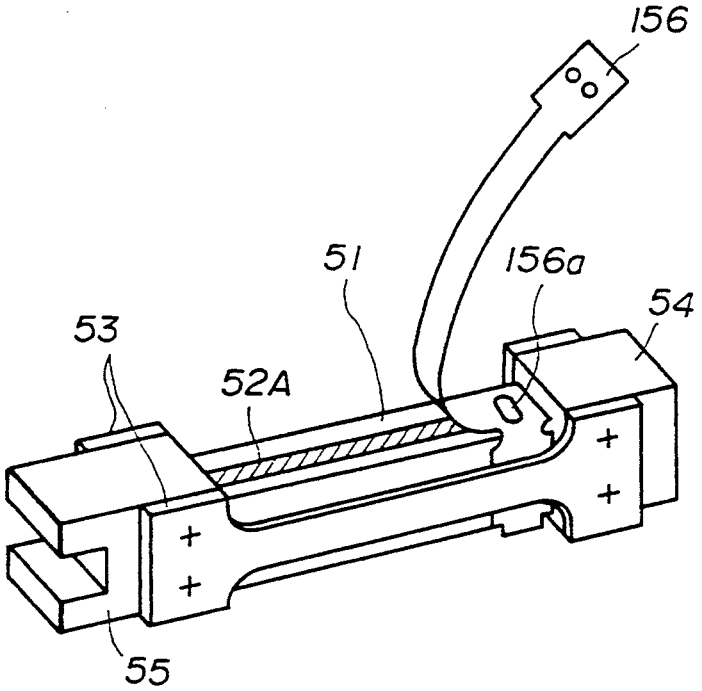
FIG. 10B is a perspective view of a piezoelectric actuator used in the embodiments of the present invention.

FIG. 10A shows an improvement in the flexible printed wiring board 56 shown in FIG. 5C. An improved flexible printed wiring board 156 shown in FIG. 10A, which has the same layer structure as shown in FIG. 5D, has cutout portions 156*c*, 156*d*, 156*e* and 156*f*. As shown in FIG. 10B, the cutout portions 156*c* and 156*d* are positioned at an edge of the piezoelectric block 51 when the flexible wiring board 156 is placed in position and wrapped around the block. Similarly, the cutout portions 156*e* and 156*f* are positioned at another edge of the piezoelectric block 51 when the flexible wiring board 156 is placed in position and wrapped. The cutout portions 156*c*–156*f* make it easy to bend the flexible wiring board 156, so that the board 156 can be brought into close contact with the piezoelectric block 51. Hence, it is easy to position the flexible wiring board 156 and prevent soldering failure. The cutout portions 156*c*–156*f* shown in FIG. 10A have a semi-oval shape. It is also possible to use cutout portions having a semi-circular shape, a rectangular shape or a triangle shape.

The flexible wiring board 156 has oval soldering windows 156*a* and 156*b* formed in the second insulating layer 59 (FIG. 5D). The major axis of each of the oval windows 156*a* and 156*b* extends in the direction perpendicular to the longitudinal direction of the electrode 52A. Thereby, it is possible to compensate for positional errors of the electrodes 52A and 52B and the flexible wiring board 156. It is also possible to employ a shape, such as a rectangular shape having the longitudinal direction perpendicular to the longitudinal direction of the electrodes 52A and 52B. The flexible wiring boards are not limited to L-shaped structures. Alternatively, flexible wiring boards having an extension extending in the direction perpendicular to the longitudinal direction of the electrodes 52A and 52B can be used. For example, such flexible wiring boards may have I-shaped or T-shaped structures. In this case, it is preferable to form cutout portions as shown in FIGS. 10A and 10B and to employ windows for soldering as shown in FIG. 10A.

The present invention can be applied to not only line printing machines but also serial printing machines. It is also possible to use an element base which is made of resin and has hooks capable of engaging the element base 103.

The present invention is not limited to the specifically disclosed embodiments, and variations and modifications may be made without departing from the scope of the present invention.

What is claimed is:

1. A print head for a wire dot-matrix printer comprising:

an element base;

a plurality of print elements engaged with and supported by the element base, each of the print elements including a print wire, an actuator moving the print wire, and a base supporting the actuator, the base of each of the print elements having an engagement hole; and an engagement member inserted into the engagement holes of the bases of the print elements, said engagement member being engaged with the bases of the print elements, wherein the engagement member has screw holes, and the print head comprises screws passing through the base element and engaging the screw holes of the engagement member.

2. The print head as claimed in claim 1, wherein the engagement member comprises a plate-shaped member having a property of resilience.

3. The print head as claimed in claim 1, wherein the engagement member comprises a plate-shaped member having a property of resilience.

4. The print head as claimed in claim 1, wherein the plate-shaped member has a plurality of indentations located between two adjacent print elements.

5. The print head as claimed in claim 1, wherein the engagement hole is a closed hole completely surrounded by an inner wall of the base.

6. The print head as claimed in claim 1, wherein the engagement hole is a partially cutout hole partially surrounded by an inner wall of the base.

7. The print head as claimed in claim 1, wherein the engagement member comprises a metallic plate-shaped member having resilience.

8. The print head as claimed in claim 1, wherein the actuator comprises:

a piezoelectric block;

a support member supporting the piezoelectric block;

a pair of electrodes respectively provided on opposite sides of the piezoelectric block; and a flexible printed wiring board having conductive patterns respectively connected to the electrodes, the flexible printed wiring board having an extension partially wrapped around the piezoelectric block and cutout portions located at edges of the piezoelectric block.

9. A print head for a wire dot-matrix printer comprising:

an element base;

a plurality of print elements engaged with and supported by the element base, each of the print elements including a print wire, an actuator moving the print wire, and a base supporting the actuator, the base of each of the print elements having an engagement hole; and an engagement member inserted into the engagement holes of the bases of the print elements, said engagement member being engaged with the bases of the print elements, wherein the plate-shaped member has a plurality of indentations located between two adjacent print elements.

10. The print head as claimed in claim 9, wherein the engagement hole is a closed hole completely surrounded by an inner wall of the base.

11. The print head as claimed in claim 9, wherein the engagement hole is a partially cutout hole partially surrounded by an inner wall of the base.

12. The print head as claimed in claim 9, wherein the engagement member comprises a metallic plate-shaped member having resilience.

13. The print head as claimed in claim 9, wherein the actuator comprises:

a piezoelectric block;

a support member supporting the piezoelectric block;

a pair of electrodes respectively provided on opposite sides of the piezoelectric block; and a flexible printed wiring board having conductive patterns respectively connected to the electrodes, the flexible printed wiring board having an extension partially wrapped around the piezoelectric block and cutout portions located at edges of the piezoelectric block.

14. The print head as claimed in claim 9, wherein the engagement member comprises a plate-shaped member having a property of resilience.

15. A print head for a wire dot-matrix printer comprising:

an element base;

a plurality of print elements engaged with and supported by the element base, each of the print elements including a print wire, an actuator moving the print wire, and a base supporting the actuator, the base of each of the print elements having an engagement hole; and an engagement member inserted into the engagement holes of the bases of the print elements, said engagement member being engaged with the bases of the print elements, wherein the actuator comprises a piezoelectric block;

a support member supporting the piezoelectric block;

a pair of electrodes respectively provided on opposite sides of the piezoelectric block; and a flexible printed wiring board having conductive patterns respectively connected to the electrodes, an insulating layer covering the conductive patterns, and soldering windows formed in the insulating layer and used for connecting the conductive patterns and the electrodes to each other, each of the soldering windows having a first length extending in a first direction in which the electrodes extend, and a second length extending in a second direction perpendicular to the first direction, and the second length being greater than the first length.

16. The print head as claimed in claim 15, wherein the engagement hole is a closed hole completely surrounded by an inner wall of the base.

17. The print head as claimed in claim 15, wherein the engagement hole is a partially cutout hole partially surrounded by an inner wall of the base.

18. The print head as claimed in claim 15, wherein the engagement member comprises a metallic plate-shaped member having resilience.

19. The print head as claimed in claim 15, wherein the actuator comprises:

a piezoelectric block;

a support member supporting the piezoelectric block;

a pair of electrodes respectively provided on opposite sides of the piezoelectric block; and a flexible printed wiring board having conductive patterns respectively connected to the electrodes, the flexible printed wiring board having an extension partially wrapped around the piezoelectric block and cutout portions located at edges of the piezoelectric block.

20. The print head as claimed in claim 15, wherein the engagement member comprises a plate-shaped member having a property of resilience.

21. A print head for a wire dot-matrix printer comprising:

an element base;

a plurality of print elements engaged with and supported by the element base, each of the print elements including a print wire, an actuator moving the print wire, and a base supporting the actuator, the base of each of the print elements having an engagement hole; and an engagement member inserted into the engagement holes of the bases of the print elements, said engagement member being engaged with the bases of the print elements, wherein the actuator comprises a piezoelectric block;

a support member supporting the piezoelectric block;

a pair of electrodes respectively provided on opposite sides of the piezoelectric block; and a flexible printed wiring board having conductive patterns respectively connected to the electrodes, an insulating layer covering the conductive patterns, and soldering windows formed in the insulating layer and used for connecting the conductive patterns and the electrodes to each other, each of the soldering windows having a first length extending in a first direction in which the electrodes extend, and a second length extending in a second direction perpendicular to the first direction, the second length being greater than the first length, and the flexible printed wiring board having an extension partially wrapped around the piezoelectric block and cutout portions located at edges of the piezoelectric block.

22. The print head as claimed in claim 21, wherein the engagement hole is a closed hole completely surrounded by an inner wall of the base.

23. The print head as claimed in claim 21, wherein the engagement hole is a partially cutout hole partially surrounded by an inner wall of the base.

24. The print head as claimed in claim 21, wherein the engagement member comprises a metallic plate-shaped member having resilience.

25. The print head as claimed in claim 21, wherein the actuator comprises:

a piezoelectric block;

a support member supporting the piezoelectric block;

a pair of electrodes respectively provided on opposite sides of the piezoelectric block; and a flexible printed wiring board having conductive patterns respectively connected to the electrodes, the flexible printed wiring board having an extension partially wrapped around the piezoelectric block and cutout portions located at edges of the piezoelectric block.

26. The print head as claimed in claim 21, wherein the engagement member comprises a plate-shaped member having a property of resilience.

27. A print head for a wire dot-matrix printer comprising:

a module base; and a plurality of element assemblies supported by the module base, each of the element assemblies comprising:

an element base supported by one of the element assemblies;

a plurality of print elements engaged with and supported by the element base, each of the print elements including a print wire, an actuator moving the print wire, and a base supporting the actuator, the base of each of the print elements having an engagement hole; and an engagement member inserted into the engagement holes of the bases of the print elements, said engagement member being engaged with the bases of the print element.

28. The print head as claimed in claim 27, wherein the engagement member comprises a plate-shaped member having a plurality of indentations located between two adjacent print elements.

29. The print head as claimed in claim 27, wherein:

the engagement member has screw holes; and the print head comprises screws passing through the base element and engaging the screw holes of the engagement member.

30. The print head as claimed in claim 27, wherein the engagement hole is a closed hole completely surrounded by an inner wall of the base.

31. The print head as claimed in claim 27, wherein the engagement hole is a partially cutout hole partially surrounded by an inner wall of the base.

32. The print head as claimed in claim 27, wherein the engagement member comprises a metallic plate-shaped member having resilience.

33. The print head as claimed in claim 27, wherein the actuator comprises:

a piezoelectric block;

a support member supporting the piezoelectric block;

a pair of electrodes respectively provided on opposite sides of the piezoelectric block; and a flexible printed wiring board having conductive patterns respectively connected to the electrodes, the flexible printed wiring board having an extension partially wrapped around the piezoelectric block and cutout portions located at edges of the piezoelectric block.

34. The print head as claimed in claim 27, wherein the engagement member comprises a plate-shaped member having a property of resilience.

35. A print head for a wire dot-matrix printer comprising:

a shuttle base; and a plurality of head units, each of the head units comprising:

a module base; and a plurality of element assemblies supported by the module base, each of the element assemblies comprising:

an element base supported by one of the element assemblies;

a plurality of print elements engaged with and supported by the element base, each of the print elements including a print wire, an actuator moving the print wire, and a base supporting the actuator, the base of each of the print elements having an engagement hole; and an engagement member inserted into the engagement holes of the bases of the print elements said engagement member being engaged with the bases of the print elements.

36. The print head as claimed in claim 35, wherein the engagement member comprises a plate-shaped member having a plurality of indentations located between two adjacent print elements.

37. The print head as claimed in claim 35, wherein:

the engagement member has screw holes; and the print head comprises screws passing through the base element and engaging the screw holes of the engagement member.

38. The print head as claimed in claim 35, wherein the engagement hole is a closed hole completely surrounded by an inner wall of the base.

39. The print head as claimed in claim 35, wherein the engagement hole is a partially cutout hole partially surrounded by an inner wall of the base.

40. The print head as claimed in claim 35, wherein the engagement member comprises a metallic plate-shaped member having resilience.

41. The print head as claimed in claim 35, wherein the actuator comprises:

a piezoelectric block;

a support member supporting the piezoelectric block;

a pair of electrodes respectively provided on opposite sides of the piezoelectric block; and a flexible printed wiring board having conductive patterns respectively connected to the electrodes, the flexible printed wiring board having an extension partially wrapped around the piezoelectric block and cutout portions located at edges of the piezoelectric block.

42. The print head as claimed in claim 35, wherein the engagement member comprises a plate-shaped member having a property of resilience.

* * * * *